US008695965B2

(12) United States Patent
Shin et al.

(10) Patent No.: US 8,695,965 B2
(45) Date of Patent: Apr. 15, 2014

(54) IMAGE FORMING APPARATUS

(75) Inventors: Dong Hyup Shin, Seongnam-si (KR); Seung Kyu Lee, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/317,732

(22) Filed: Oct. 27, 2011

(65) Prior Publication Data

US 2012/0126475 A1 May 24, 2012

(30) Foreign Application Priority Data

Nov. 18, 2010 (KR) ..... 10-2010-0114762

(51) Int. Cl.
*B65H 3/52* (2006.01)

(52) U.S. Cl.
USPC ..... 271/121; 271/164; 271/124; 271/162

(58) Field of Classification Search
USPC ..... 271/162, 164, 121, 122, 124, 125
See application file for complete search history.

(56) References Cited

U.S. PATENT DOCUMENTS 4,372,676 A * 2/1983 Miyata et al. ..... 399/21
4,740,817 A * 4/1988 Suzuki et al. ..... 399/392
4,793,606 A * 12/1988 Yasuoka et al. ..... 271/157
5,451,043 A * 9/1995 Arai ..... 271/122
5,568,166 A 10/1996 Yamazaki
7,922,167 B2 * 4/2011 Kajiyama et al. ..... 271/4.01
8,113,505 B2 * 2/2012 Lee ..... 271/167
2006/0255528 A1 * 11/2006 Okada et al. ..... 271/121
2010/0156033 A1 * 6/2010 Lee ..... 271/121

FOREIGN PATENT DOCUMENTS

EP 2 199 238 11/2009

OTHER PUBLICATIONS

European Search Report issued Nov. 4, 2013 in corresponding European Application No. 11187241.2.

* cited by examiner

*Primary Examiner* — Luis A Gonzalez
(74) *Attorney, Agent, or Firm* — Staas & Halsey LLP

(57) ABSTRACT

An image forming apparatus having a structure to prevent print defects caused by residual paper. The image forming apparatus includes a main body, a paper feeding cassette separably mounted to the main body, a pickup member to pick up paper from the paper feeding cassette, and a paper separating member including a plurality of links to apply pressure to the pickup member when the paper feeding cassette is mounted to the main body and to release the pressure applied to the pickup member when the paper feeding cassette is separated from the main body. The paper separating member includes a first link to be pressed by the paper feeding cassette, a second link provided with a separating unit to press the pickup member, and an elastic member between the first link and the second link to allow the first link to press the second link.

18 Claims, 9 Drawing Sheets

IMAGE FORMING APPARATUS

CROSS-REFERENCE TO RELATED APPLICATIONS

This application claims the benefit of Korean Patent Application No. 2010-0114762, filed on Nov. 18, 2010 in the Korean Intellectual Property Office, the disclosure of which is incorporated herein by reference.

BACKGROUND

1. Field

Embodiments of the present disclosure relate to an image forming apparatus having an improved paper feeding structure.

2. Description of the Related Art

An image forming apparatus is designed to form an image on a printing medium based on an input image signal. Examples of image forming apparatuses include printers, copiers, fax machines, and devices combining functions thereof. Hereinafter, print media is referred to as 'paper' for convenience, but is not limited to general paper.

An image forming apparatus contains a paper feeding device to feed paper to a printing device provided therein. Paper accommodated in the paper feeding device is picked up by a pickup unit and is delivered to the printing device along a predetermined path.

The pickup unit normally picks up a sheet of paper with one operation thereof, but two or more sheets of paper may be picked up. If two or more sheets of paper are picked up and delivered to the printing device, print defects or jam may occur.

To prevent the above-described print defects or jam, a separating unit is generally employed. The separating unit is arranged to face the pickup unit so as to press paper against the pickup unit. If the pickup unit picks up two or more sheets of paper, the separating unit separates the two or more sheets of paper into individual sheets, allowing only one sheet of paper to be delivered to the printing device.

In this case, the paper not delivered to the printing device (hereinafter, referred to as residual paper) may be jammed between the separating unit and the pickup unit rather than being delivered backward to a paper feeding cassette. The paper feeding cassette is coupled to a main body of the image forming apparatus and is separable from the main body, e.g., when adding paper. If a user attempts to reinstall the paper feeding cassette into the main body after supplying paper into the paper feeding cassette in a state in which the user does not recognize the paper jam, the residual paper may be crumpled by the paper feeding device, causing the paper feeding cassette to be imperfectly coupled to the main body, or resulting in print defects.

In addition, even if the user recognizes the presence of the residual paper and attempts to remove the residual paper, easy removal of the paper may be difficult due to contact pressure between the separating unit and the pickup unit, and the separating unit or the pickup unit may be damaged if the paper is forcibly removed.

SUMMARY

It is one aspect of the present disclosure to provide an image forming apparatus, which enables removal of residual paper with a simplified structure.

Additional aspects of the disclosure will be set forth in part in the description which follows and, in part, will be apparent from the description, or may be learned by practice of the disclosure.

In accordance with one aspect of the disclosure, an image forming apparatus includes a main body containing a printing device, a paper feeding cassette configured to accommodate paper therein and separably mounted to the main body, a pickup member to pick up the paper from the paper feeding cassette, and a paper separating member including a plurality of links to apply pressure to the pickup member when the paper feeding cassette is mounted to the main body and to release the pressure applied to the pickup member when the paper feeding cassette is separated from the main body, wherein the paper separating member includes a first link to be pressed by the paper feeding cassette, a second link provided with a separating unit to press the pickup member so as to prevent delivery of plural sheets of paper, and an elastic member provided between the first link and the second link to allow the first link, pressed by the paper feeding cassette, to press the second link.

The paper feeding cassette may include a cassette body in which the paper is accommodated, and a knock-up plate pivotally rotatably provided in the paper feeding cassette to support the paper accommodated in the paper feeding cassette, and a press member may be provided at a front surface of the paper feeding cassette to press the first link when the paper feeding cassette is mounted to the main body.

The press member may protrude forward from the front surface of the paper feeding cassette.

The press member may include a press surface, the first link may include a contact surface to come into contact with the press surface, and the press surface may press the contact surface to pivotally rotate the first link when the paper feeding cassette is mounted to the main body.

The first link may press the elastic member when the paper feeding cassette is mounted to the main body, and the elastic member pressed by the first link may pivotally rotate the second link to press the separating unit.

The pickup member may include a support frame, a pickup roller rotatably installed to the support frame, and a forward roller rotatably installed to the support frame, the forward roller coming into contact with the separating unit when the paper feeding cassette is mounted to the main body, and the forward roller may prevent delivery of plural sheets of paper picked up by the pickup roller.

The image forming apparatus may further include a guide frame to guide the paper picked up by the pickup member, and the first link and the second link may be pivotally rotatably installed to the guide frame.

The first link and the second link may be pivotally rotated in opposite directions when the paper feeding cassette is mounted to the main body.

The separating unit may include a separating roller provided with a torque limiter to apply resistance force in an opposite direction of a paper delivery direction.

The separating unit may include a pad member to apply resistance force in the opposite direction of the paper delivery direction.

In accordance with another aspect of the present disclosure, an image forming apparatus includes a main body containing a printing device, a paper feeding cassette configured to accommodate paper therein and separably mounted to the main body, a support frame arranged within the main body, a pickup roller rotatably installed to the support frame and serving to pick up the paper from the paper feeding cassette, a forward roller rotatably installed to the support frame and serving to deliver the paper picked up by the pickup roller, and a paper separating member to separate plural sheets of paper, picked up by the pickup roller, into individual sheets, wherein the paper separating member includes a guide frame, a plurality of links pivotally rotatably installed to the guide frame, and a separating unit coupled to any one of the plurality bf links, the separating unit coming into contact with the forward roller when the paper feeding cassette is mounted to the main body.

The paper feeding cassette may apply pressure to the paper separating member when the paper feeding cassette is mounted to the main body and may release the pressure applied to the paper separating member when the paper feeding cassette is separated from the main body.

The paper feeding cassette may include a cassette body in which the paper is accommodated, and a knock-up plate pivotally rotatably provided in the paper feeding cassette to support the paper accommodated in the paper feeding cassette, and a press member may be provided at a front surface of the paper feeding cassette to press the paper separating member when the paper feeding cassette is mounted to the main body.

The press member may protrude forward from the front surface of the paper feeding cassette.

The plurality of links may include a first link and a second link connected to each other via an elastic member, and one end of the elastic member may be supported by the first link and the other end of the elastic member may be supported by the second link.

One end of the first link may include a contact surface to come into contact with the press member and the other end of the first link may include a first support portion to support the end of the elastic member, and one end of the second link may include a coupling portion coupled to the separating unit and the other end of the second link may include a second support portion to support the other end of the elastic member.

The first link may come into contact with the press member and may be pivotally rotated to press the elastic member when the paper feeding cassette is mounted to the main body, and the elastic member pressed by the first link pivotally may rotate the second link to press the forward roller.

The first link and the second link may be pivotally rotated in opposite directions when the paper feeding cassette is mounted to or separated from the main body.

The guide frame may include a support rib to restrict pivotal rotation of the first link when the paper feeding cassette is separated from the main body.

The separating unit may include a separating roller provided with a torque limiter to apply resistance force in an opposite direction of a paper delivery direction.

The separating unit may include a pad member to apply resistance force in the opposite direction of the paper delivery direction.

In accordance with a further aspect of the present disclosure, an image forming apparatus includes a main body containing a printing device, a paper feeding cassette configured to accommodate paper therein and separably mounted to the main body, a support frame arranged within the main body, a pickup roller rotatably installed to the support frame and serving to pick up the paper from the paper feeding cassette, a forward roller rotatably installed to the support frame and serving to deliver the paper picked up by the pickup roller, and a paper separating member to separate plural sheets of paper, picked up by the pickup roller, into individual sheets, wherein the paper separating member includes a first link adapted to be pivotally rotated in linkage with the paper feeding cassette, a second link connected to the first link so as to be pivotally rotated in an opposite direction of a pivotal rotating direction of the first link, and a separating unit coupled to one end of the second link, and the separating unit is located at a first position to apply pressure to the forward roller when the paper feeding cassette is mounted to the main body, and is located at a second position to release the pressure applied to the forward roller when the paper feeding cassette is separated from the main body.

The separating unit may include a separating roller provided with a torque limiter to apply resistance force in an opposite direction of a paper delivery direction.

The separating unit may include a pad member to apply resistance force in the opposite direction of the paper delivery direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
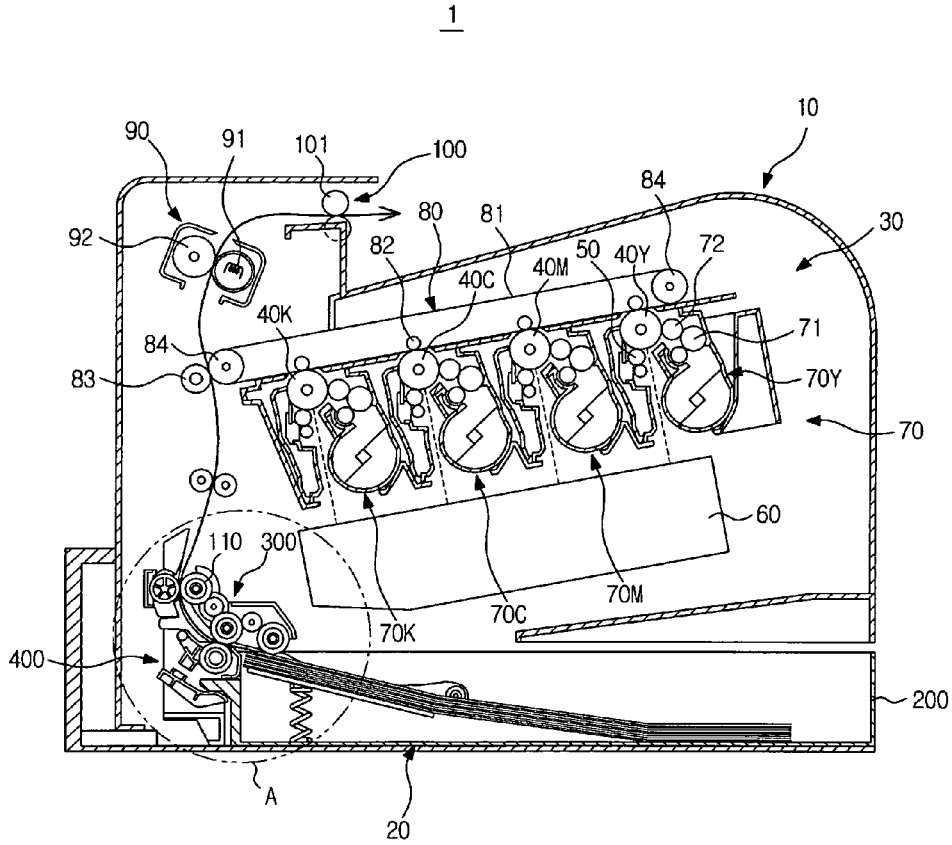
FIG. 1 is a view illustrating a configuration of an image forming apparatus according to an embodiment.

Reference will now be made in detail to the exemplary embodiment of the present disclosure, examples of which are illustrated in the accompanying drawings, wherein like reference numerals refer to like elements throughout.

FIG. 1 is a view illustrating a configuration of an image forming apparatus according to an embodiment.

As illustrated in FIG. 1, the image forming apparatus 1 includes a main body 10, a paper feeding device 20, a printing device 30, and a paper discharge device 100.

The main body 10 defines an external appearance of the image forming apparatus and supports a variety of elements installed therein. The paper feeding device 20 feeds paper into the printing device 30. The paper feeding device 20 will be described in detail hereinafter.

The printing device 30 prints an image on the paper fed from the paper feeding device 20. The present embodiment describes an electro-photographic image forming apparatus. The printing device 30 includes photoconductors 40K, 40C, 40M, and 40Y, a charging device 50, a light scanning device 60, a developing device 70, a transfer device 80, and a fusing device 90.

The charging device 50 uniformly charges surfaces of the photoconductors 40K, 40C, 40M and 40Y. The light scanning device 60 irradiates light corresponding to image information to the charged photoconductors 40K, 40C, 40M and 40Y, thereby forming electrostatic latent images on the surfaces of the photoconductors 40K, 40C, 40M and 40Y.

The developing device 70 forms visible images by supplying toners to the electrostatic latent images formed on the photoconductors 40K, 40C, 40M and 40Y. The developing device 70 includes four developing units 70K, 70C, 70M and 70Y in which different colors or toners, for example, black, cyan, magenta, and yellow toners are accommodated respectively.

Each of the developing units 70K, 70C, 70M and 70Y may include a supply roller 71 and a developing roller 72. The supply roller 71 supplies toner to the developing roller 72. The developing roller 72 supplies the toner to the photoconductor so as to develop an electrostatic latent image into a visible image.

The transfer device 80 may include a transfer belt 81, first transfer rollers 82, a second transfer roller 83, and support rollers 84. The transfer belt 81 comes into contact with the photoconductors 40K, 40C, 40M and 40Y and is rotatably supported by the support rollers 84.

The visible images formed respectively on the photoconductors 40K, 40C, 40M and 40Y are transferred to the transfer belt 81 by the first transfer rollers 82 so as to overlap one another. The resulting image on the transfer belt 81 is transferred to paper fed from the paper feeding device 20 while the paper passes between the second transfer roller 83 and the transfer belt 81.

The paper having passed through the transfer device 80 enters the fusing device 90. The fusing device 90 includes a heating roller 91 and a pressure roller 92. As heat and pressure are applied to the paper passing between the heating roller 91 and the pressure roller 92, the image transferred to the paper is fixed to the paper.

The paper having passed through the fusing device 90 is guided to the paper discharge device 100 and is discharged out of the main body 10 by a paper discharge roller 101.

Figure 2:
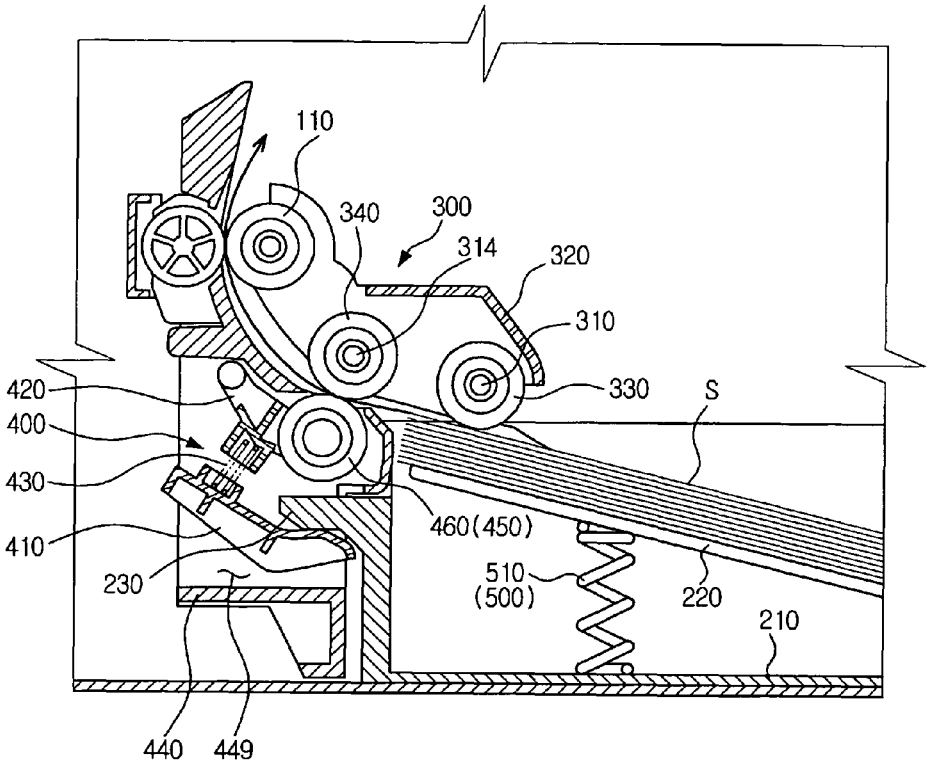
FIG. 2 is an enlarged view of the portion 'A' of FIG. 1.
Figure 3:
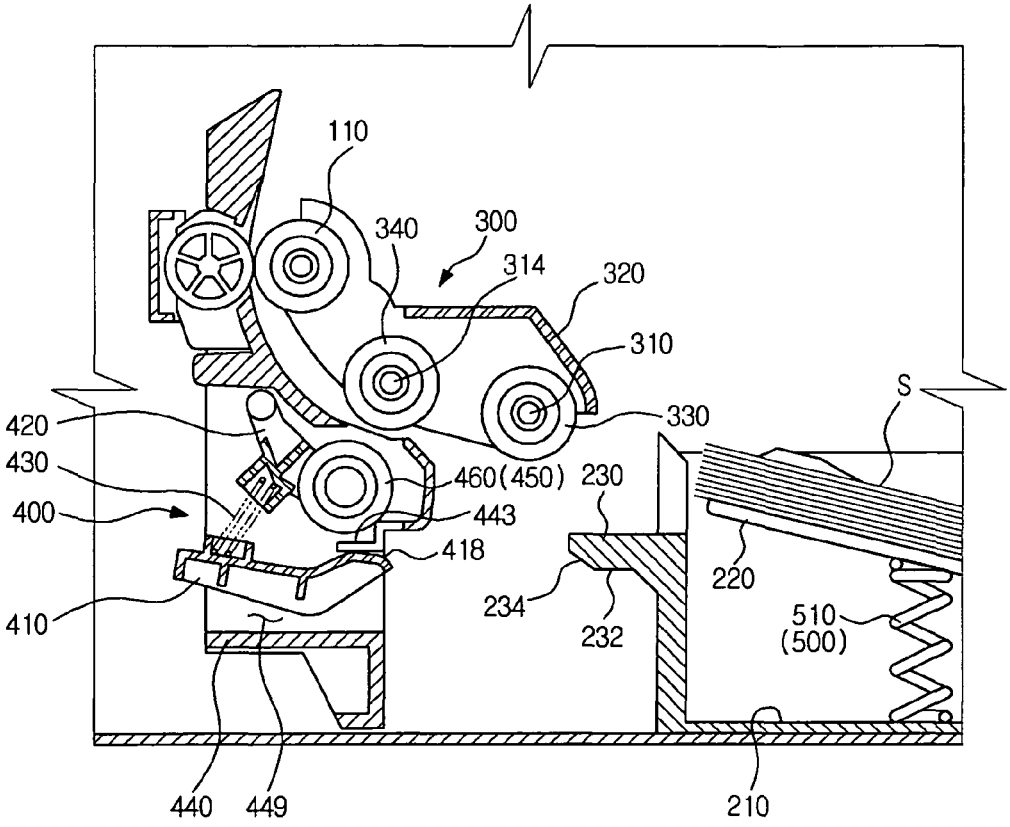
FIG. 3 is a view illustrating separation of a paper feeding cassette illustrated in FIG. 2.
Figure 4:
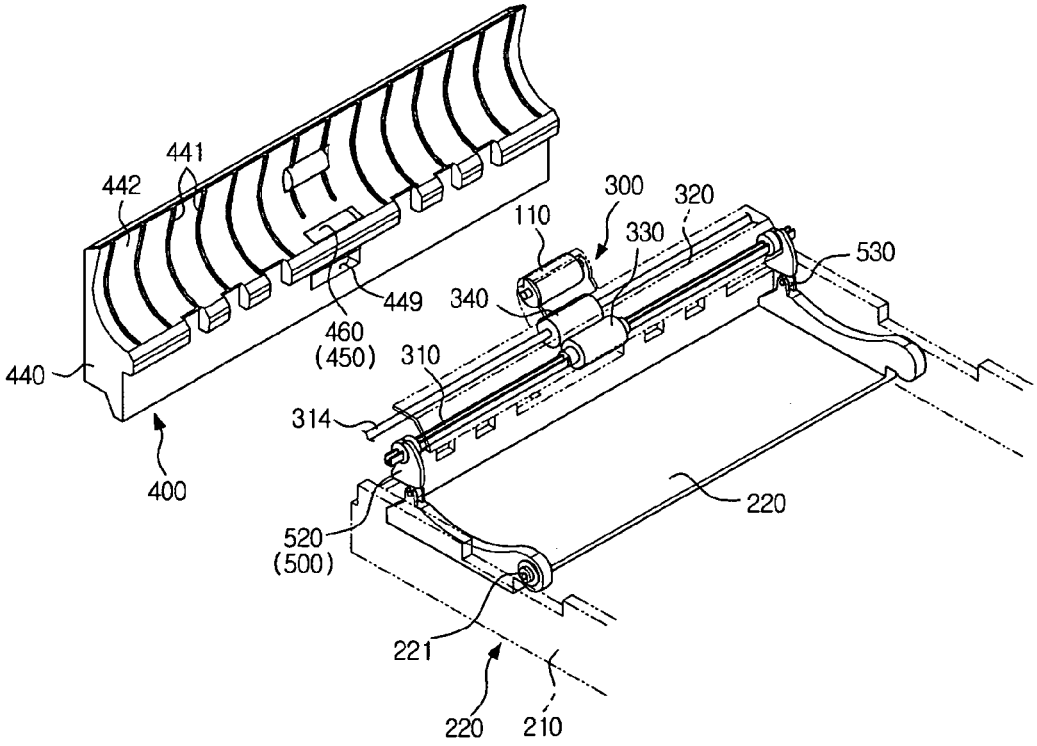
FIG. 4 is a perspective view illustrating a configuration of a paper feeding device for the image forming apparatus according to an embodiment.
Figure 5:
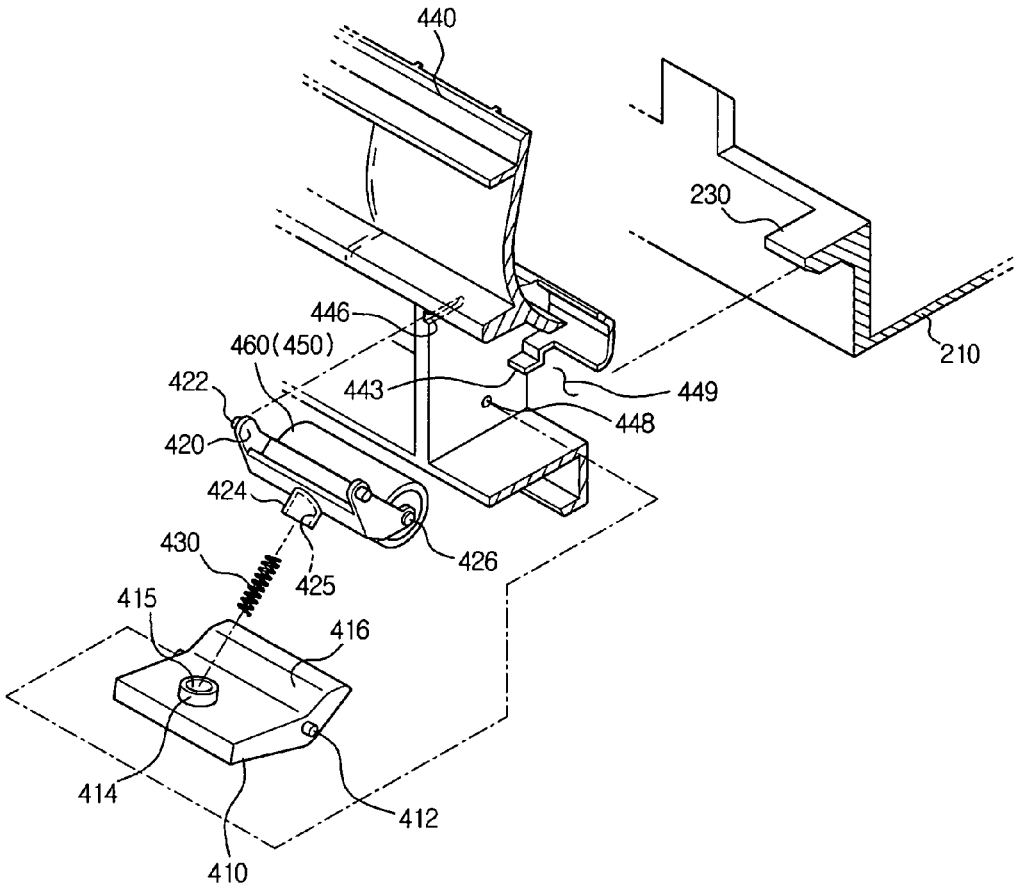
FIG. 5 is a perspective view illustrating a paper separating member and a part of the paper feeding device for the image forming apparatus according to an embodiment.

FIG. 2 is an enlarged view of the portion 'A' of FIG. 1, FIG. 3 is a view illustrating separation of a paper feeding cassette illustrated in FIG. 2, and FIG. 4 is a perspective view illustrating a configuration of the paper feeding device for the image forming apparatus according to an embodiment. FIGS. 4 and 5 illustrate a guide frame and a paper feeding cassette separated from each other.

As illustrated in FIGS. 2 to 4, the paper feeding device 20 includes a paper feeding cassette 200, a pickup member 300, and a paper separating member 400.

The paper feeding cassette 200 is configured to accommodate the paper S therein and is separably mounted to the main body 10.

The paper feeding cassette 200 includes a cassette body 210 in which the paper S is accommodated, a knock-up plate 220 to support the accommodated paper S, and a press member 230 to press a first link 410 of the paper separating member 400.

The knock-up plate 220 is pivotally rotatably installed to the cassette body 210. More specifically, the knock-up plate 220 is coupled to the cassette body 210 via a hinge shaft 221 provided at a rear end thereof such that a front end of the knock-up plate 220 is pivotally rotatable in a vertical direction.

The press member 230 protrudes from a front surface of the cassette body 210 and includes a press surface 232 and a first inclined surface 234. The press surface 232 presses a contact surface 416 provided at the first link 410 to pivotally rotate the first link 410 when the paper feeding cassette 200 is installed into the main body 10. The first inclined surface 234 helps the press surface 232 to naturally move onto the contact surface 416 as the press member 230 is brought into contact with the first link 410.

The pickup member 300 is provided above the front end of the knock-up plate 220. The pickup member 300 picks up the paper S in the paper feeding cassette 200 and delivers the paper S to a delivery roller 110. To this end, the pickup member 300 includes a support frame 320, and a pickup roller 330 and a forward roller 340 which are rotatably coupled to the support frame 320.

The support frame 320 is placed in the main body 10 and includes a pickup shaft 310 and a forward shaft 314, which are rotatably installed to the main body 10. The pickup shaft 310 and the forward shaft 314 are rotated upon receiving power from a drive motor (not shown) provided in the main body 10.

The pickup roller 330 is rotatably coupled to the pickup shaft 310. The pickup roller 330 picks up the paper S loaded on the knock-up plate 220 and delivers the paper S to the forward roller 340. The forward roller 340 is rotatably coupled to the forward shaft 314. The forward roller 340 transmits the paper S delivered from the pickup roller 330 to the delivery roller 110 in cooperation with a separating unit 450.

The separating unit 450 applies predetermined pressure to the forward roller 340. As such, only one sheet of paper is allowed to pass between the forward roller 340 and the separating unit 450 and be delivered to the delivery roller 110.

The delivery roller 110 aligns a front end of the paper delivered from the pickup member 300 and delivers the paper to the second transfer roller (83, FIG. 1).

The paper feeding device 20 includes an elevating device 500 to vertically move the knock-up plate 220. The elevating device 500 includes a spring 510 to elastically bias the knock-up plate 220 upward, and a pair of cams 520 coupled to both ends of the pickup shaft 310 with the pickup roller 330 interposed therebetween so as to be rotated along with the pickup roller 330.

The cams 520 press both sidewalls of the knock-up plate 220 within a specific rotation range of the pickup shaft 310, thereby pivotally rotating the knock-up plate 220 downward. The knock-up plate 220 may be provided at the sidewalls thereof with guide rollers 530 to ensure that the cams 520 smoothly press the knock-up plate 220.

Once the cams 520 are rotated and spaced apart from the knock-up plate 220, the knock-up plate 220 is pivotally rotated upward by the spring 510.

FIG. 5 is a perspective view illustrating the paper separating member and a part of the paper feeding device for the image forming apparatus according to an embodiment.

As illustrated in FIGS. 2, 3 and 5, the paper separating member 400 is placed in front of the paper feeding cassette 200. The paper separating member 400 presses the forward roller 340 to deliver the paper picked by the pickup roller 330 to the delivery roller 110.

The paper separating member 400 includes the first link 410 operated in linkage with the paper feeding cassette 200, a second link 420 connected to the first link 410, an elastic member 430 to connect the first link 410 and the second link 420 to each other, the separating unit 450 coupled to the second link 420 to press the pickup member 300, and a guide frame 440 to which the first link 410 and the second link 420 are coupled.

The guide frame 440 is placed in front of the paper feeding cassette 200 and includes a guide surface 442 to guide the paper picked up by the pickup roller 330 to the delivery roller 110. A plurality of ribs 441 is formed on the guide surface 442 and extends in a paper delivery direction.

The guide frame 440 is provided with a receptacle 449 in which the first link 410 and the second link 420 are accommodated. The receptacle 449 is provided with a hinge hole 448 such that the first link 410 is pivotally rotatably coupled to the guide frame 440. The receptacle 449 is also provided with a hinge groove 446 such that the second link 420 is pivotally rotatably coupled to the guide frame 440. One end of the hinge groove 446 may be open to enable easy coupling of the second link 420.

A support rib 443 protrudes from one side of the receptacle 449. The support rib 443 supports one surface of the first link 410 when the paper feeding cassette 210 is coupled to or separated from the main body 10, thereby limiting a pivotal rotation angle of the first link 410.

The first link 410 is accommodated in the receptacle 449 of the guide frame 440. The first link 410 includes a first hinge 412 to couple the first link 410 to the receptacle 449, a first support portion 414 to support the elastic member 430, the contact surface 416 to come into contact with the press member 230, and a second inclined surface 418.

The first hinge 412 protrudes from a lateral surface of the first link 410 by a predetermined length and is inserted into the hinge hole 448 formed in the receptacle 449.

The first support portion 414 is provided on the top of the first link 410. A first support recess 415 is formed in the first support portion 414 such that one end of the elastic member 430 is fitted and supported in the first support recess 415.

The contact surface 416 is provided on the top of the first link 410. The contact surface 416 is brought into contact with the press surface 232 as the paper feeding cassette 210 is introduced into the main body 10, causing the first link 410 to be pivotally rotated downward. The second inclined surface 418 extends from the contact surface 416 and helps the contact surface 416 to be naturally located beneath the press surface 232 as the first link 410 is brought into contact with the press member 230.

The second link 420 is placed above the first link 410 within the receptacle 449 of the guide frame 440. The second link 420 includes a second hinge 422 to couple the second link 420 to the receptacle 449, a second support portion 424 to support the elastic member 430, and a coupling portion 426 for coupling of the separating unit 450.

The second hinge 422 protrudes from a lateral surface of the second link 420 by a predetermined length and is inserted into the hinge groove 446 formed in the receptacle 449.

The second support portion 424 is provided on the bottom of the second link 420. A second support recess 425 is formed in the second support portion 424 such that the other end of the elastic, member 430 is fitted and supported in the second support recess 425.

The coupling portion 426 is provided at one side of the second link 420. Assuming that a separating roller 460 serves as the separating unit 450, the coupling portion 426 may take the form of a hole such that the separating roller 460 is rotatable about the coupling portion 426. Alternatively, assuming that a pad member 560 serves as the separating unit 450, the coupling portion 426 may take the form of a groove such that the pad member 560 is fixed to the coupling portion 426 (see FIGS. 6 and 7).

The elastic member 430 connects the first link 410 and the second link 420 to each other such that the first link 410 and the second link 420 are movable in linkage with each other. One end of the elastic member 430 is received and supported in the first support recess 415 formed in the first support portion 414, and the other end of the elastic member 430 is received and supported in the second support recess 425 formed in the second support portion 424.

The elastic member 430 is pressed or released according to movement of the first link 410 and transmits pressure applied from the first link 410 to the second link 420, enabling pivotal rotation of the second link 420.

The separating unit 450 is coupled to the coupling portion 426 of the second link 420 so as to press the pickup member 300.

The separating roller 460 or the pad member 560 may serve as the separating unit 450. As illustrated in FIGS. 1 to 5, assuming use of the separating roller 460, the separating roller 460 is rotatably coupled to the coupling portion 426.

If two or more sheets of paper are delivered in a state in which the separating roller 460 is pressing the pickup member 300, the separating roller 460 separates the sheets of paper into individual sheets, allowing only one sheet of paper to be delivered to the printing device 30.

The separating roller 460 may be provided with a torque limiter to apply frictional resistance force in an opposite direction of a paper delivery direction.

Figure 6:
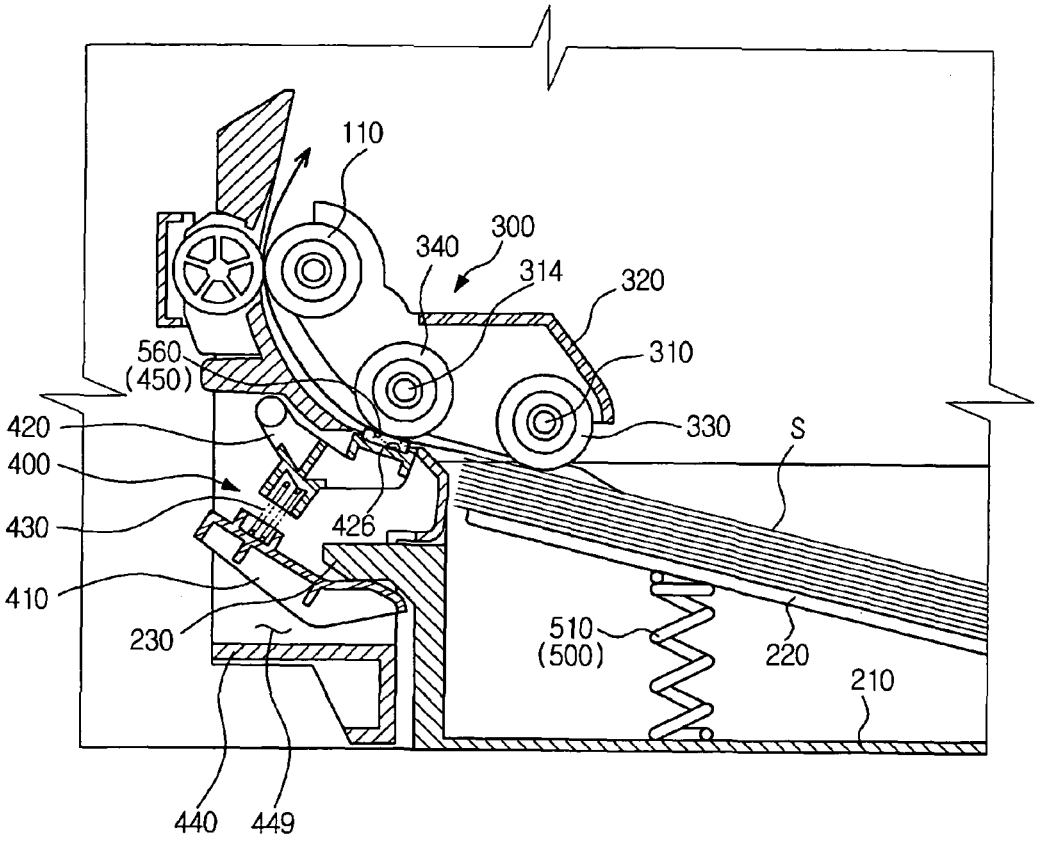
FIG. 6 is a view illustrating a pad member serving as a separating unit illustrated in FIG. 2.
Figure 7:
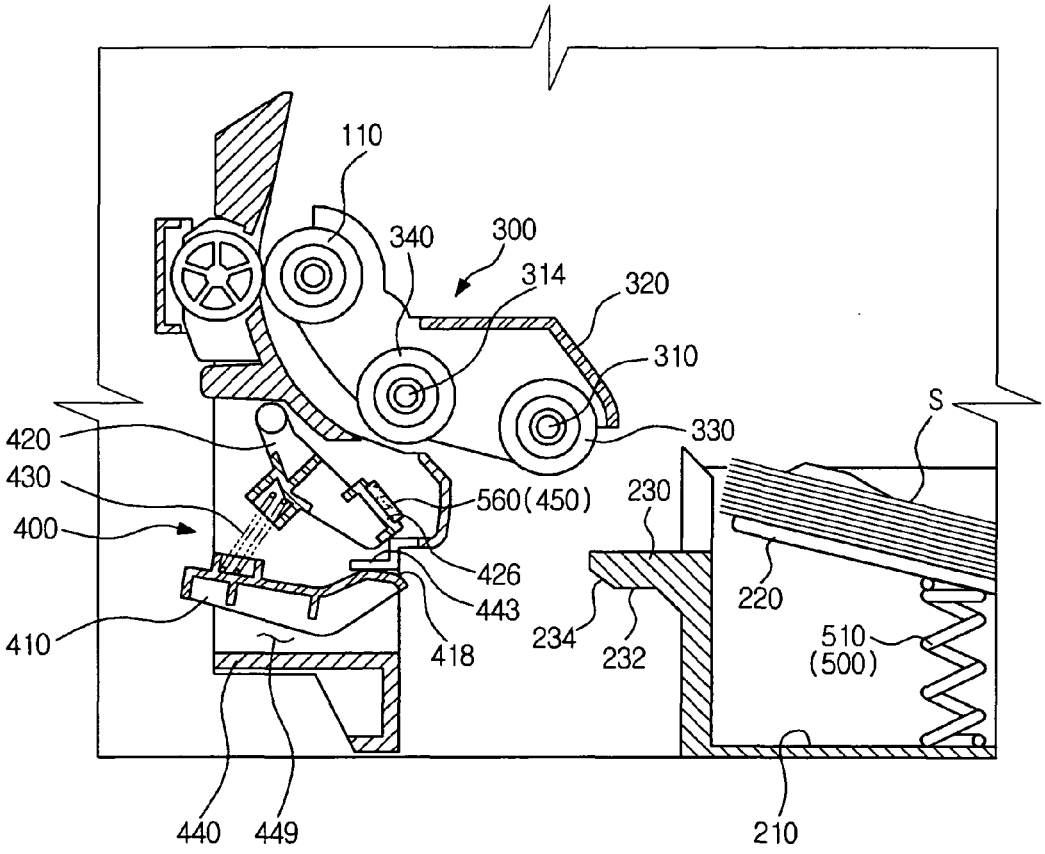
FIG. 7 is a view illustrating separation of the paper feeding cassette illustrated in FIG. 6.

FIG. 6 is a view illustrating the pad member serving as the separating unit illustrated in FIG. 2, and FIG. 7 is a view illustrating separation of the paper feeding cassette illustrated in FIG. 6.

As illustrated in FIGS. 6 and 7, the pad member 560 may serve as the separating unit 450.

The pad member 560 is fixed to the coupling portion 426 in the form of a groove (see FIGS. 6 and 7) and selectively applies pressure to the pickup member 300 according to movement of the second link 420.

Similar to the separating roller 460, the pad member 560 applies frictional resistance force in an opposite direction of a paper delivery direction. As such, if two or more sheets of paper are delivered in a state in which the pad member 560 is pressing the pickup member 300, the pad member 560 separates the sheets of paper into individual sheets, thus allowing only one sheet of paper to be delivered to the printing device 30.

Figure 8:
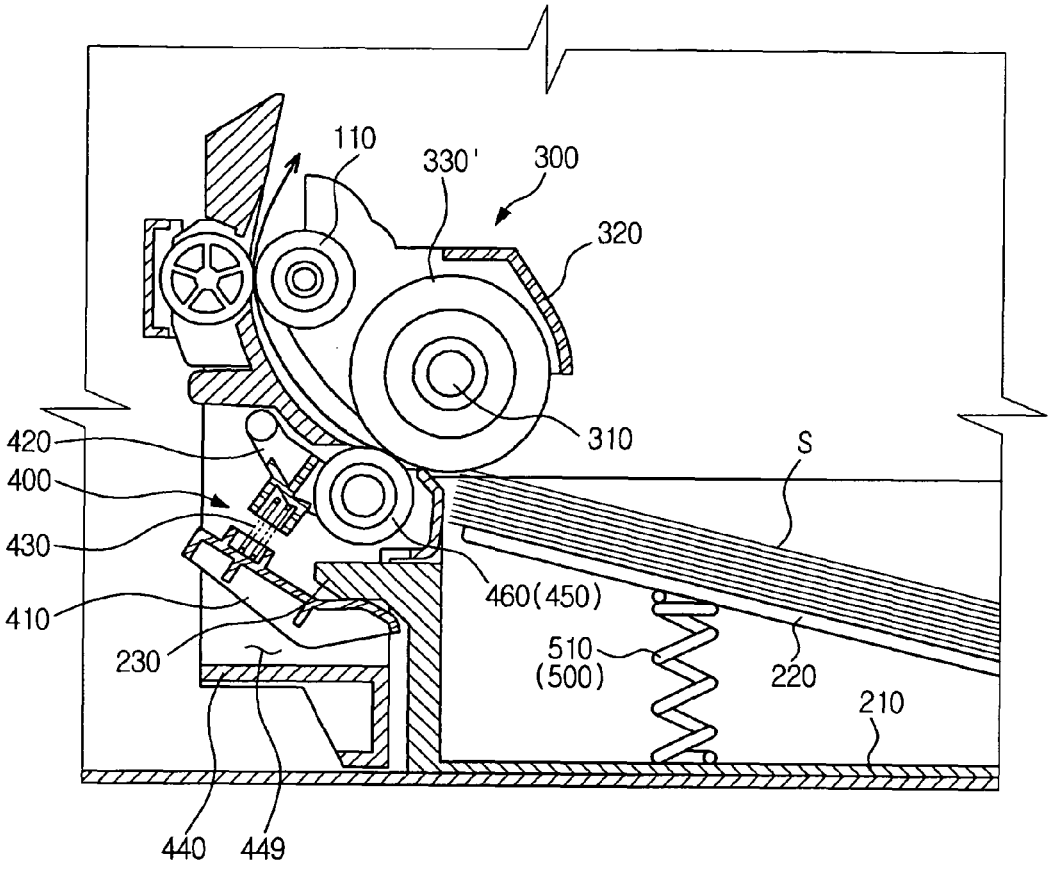
FIG. 8 is a view illustrating a pickup member in the form of a single pickup roller (under the assumption of using a separating roller as the separating unit)
Figure 9:
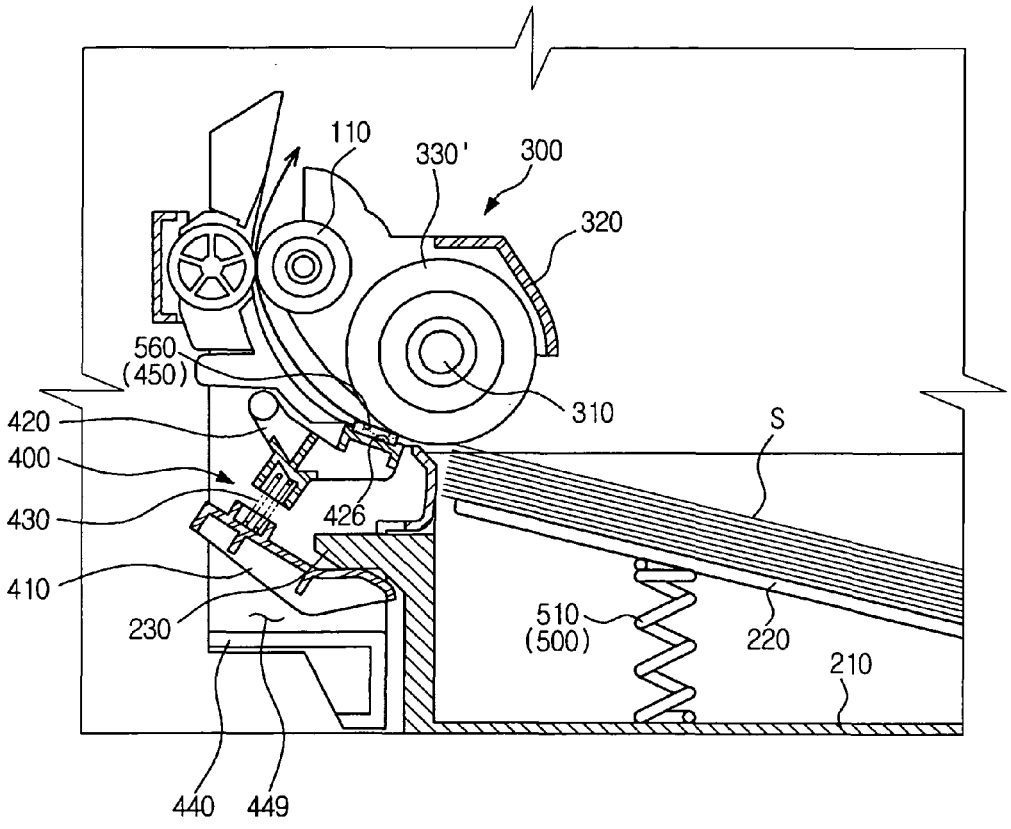
FIG. 9 is a view illustrating a pickup member in the form of a single pickup roller (under the assumption of using the pad member as the separating unit).

FIGS. 8 and 9 are views illustrating the pickup member in the form of a single pickup roller (FIG. 8 illustrates the case of using the separating roller as the separating unit, and FIG. 9 illustrates the case of using the pad member as the separating unit).

As illustrated in FIGS. 8 and 9, the pickup member 300 may be constructed by coupling a single pickup roller 330' to the support frame 320. In this case, the pickup roller 330' may simultaneously perform the function of the pickup roller 330 to pick up paper and the function of the forward roller 340 to separate and deliver paper. The pickup roller 330' may have a greater diameter than a diameter of the pickup roller 330 or the forward roller 340.

Other configurations are identical to those of the pickup member 330 consisting of the pickup roller 330 and the forward roller 340 and thus, a detailed description thereof is omitted.

Hereinafter, a paper feeding operation and a residual paper removing operation of the image forming apparatus according to the embodiment will be described with reference to FIGS. 2 and 3.

As illustrated in FIGS. 2 and 6, once the paper feeding cassette 200 is mounted to the main body 10, the press member 230 of the paper feeding cassette 200 presses the first link 410 to pivotally rotate the first link 410. As the first link 410 is pivotally rotated about the first hinge 412, the elastic member 430 is pressed upward by the first link 410.

The elastic member 430 pressed by the first link 410 transmits compressive force to the second link 420, causing the second link 420 to be pivotally rotated in an opposite direction of a rotating direction of the first link 410. With pivotal rotation of the second link 420, the separating unit 450 coupled to the second link 420 (the separating roller 460 or the pad member 560) is moved upward to come into contact with the forward roller 340. In this case, the separating unit 450 and the forward roller 340 maintain a contact pressure equal to elasticity of the compressed elastic member 430.

The contact pressure generates friction between the separating unit 450 and the forward roller 340. When the paper loaded in the paper feeding cassette 200 is picked up by the pickup roller 330 and is introduced between the separating unit 450 and the forward roller 340, the friction acts as paper delivery force, allowing the paper to be delivered to the delivery roller 110.

In the meantime, as described above, the press member 230 and the first link 410 come into surface contact with each other via the press surface 232 and the contact surface 416. Thus, even if the paper feeding cassette 200 deviates from an original coupling position thereof within a predetermined range due to external shock applied to the image forming apparatus 1 or potential vibration during paper printing, the contact pressure between the separating unit 450 and the forward roller 340 are maintained before the press surface 232 and the contact surface 416 are completely separated from each other, which ensures stable implementation of a printing operation and eliminates print defects.

If two or more sheets of paper are picked up at once by the pickup roller 330 and are introduced between the separating unit 450 and the forward roller 340, only one sheet of paper that comes into direct contact with the forward roller 340 is separated and delivered. This is because friction between the forward roller 340 and the paper or between the separating unit 450 and the paper is greater than friction between the sheets of paper.

The residual paper remains between the separating unit 450 and the forward roller 340 and begins to move from this position for the next printing operation.

If a user removes the paper feeding cassette 200 without recognizing the presence of residual paper between the separating unit 450 and the forward roller 340 prior to performing the next printing operation, as illustrated in FIGS. 3 and 7, pressure applied to the first link 410 is released as the press member 230 is separated from the first link 410 and the compressed elastic member 430 is returned to an original length thereof, pressing the first link 410.

With restoration of the elastic member 430 and the weight of the first link 410, the first link 410 is pivotally rotated in an opposite direction of the previous pivotal rotating direction in which the first link 410 is pressed by the press member 230. Simultaneously, the second link 420 is pivotally rotated by the weight thereof, causing the separating unit 450 to be separated from the forward roller 340.

In this case, as one end of the residual paper comes into contact with the separating unit 450 and the other end of the residual paper comes into contact with paper loaded in the paper feeding cassette 200, the paper is supported at a stationary position. Since the residual paper is only affected by fiction with the paper loaded in the paper feeding cassette 200, the residual paper may be frictionally pulled out of the main body 10 along with the paper feeding cassette 200 during removal of the paper feeding cassette 200.

As is apparent from the above description, one or more embodiments include an image forming apparatus, which may prevent print defects due to residual paper.

Although the embodiment of the present disclosure has been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a main body containing a printing device;

a paper feeding cassette configured to accommodate paper therein and separably mounted to the main body;

a pickup member to pick up the paper from the paper feeding cassette; and a paper separating member including a plurality of links to apply pressure to the pickup member when the paper feeding cassette is mounted to the main body and to release the pressure applied to the pickup member when the paper feeding cassette is separated from the main body, wherein the paper separating member includes a first link to be pressed by the paper feeding cassette;

a second link provided with a separating unit to press the pickup member so as to prevent delivery of plural sheets of paper; and an elastic member provided between the first link and the second link to allow the first link, pressed by the paper feeding cassette, to press the second link, wherein the first link and the second link are pivotally rotated in opposite directions when the paper feeding cassette is mounted to or separated from the main body, and wherein the paper feeding cassette includes a press member provided at a front surface of the paper feeding cassette to press the first link when the paper feeding cassette is mounted to the main body.

2. The apparatus according to claim 1, wherein the paper feeding cassette further includes:

a cassette body in which the paper is accommodated; and a knock-up plate pivotally rotatably provided in the paper feeding cassette to support the paper accommodated in the paper feeding cassette.

3. The apparatus according to claim 2, wherein the press member protrudes forward from the front surface of the paper feeding cassette.

4. The apparatus according to claim 3, wherein the press member includes a press surface, wherein the first link includes a contact surface to come into contact with the press surface, and wherein the press surface presses the contact surface to pivotally rotate the first link when the paper feeding cassette is mounted to the main body.

5. The apparatus according to claim 4, wherein the first link presses the elastic member when the paper feeding cassette is mounted to the main body, and wherein the elastic member pressed by the first link pivotally rotates the second link to press the separating unit.

6. The apparatus according to claim 1, wherein the pickup member includes:

a support frame;

a pickup roller rotatably installed to the support frame; and a forward roller rotatably installed to the support frame, the forward roller coming into contact with the separating unit when the paper feeding cassette is mounted to the main body, and wherein the forward roller prevents delivery of plural sheets of paper picked up by the pickup roller.

7. The apparatus according to claim 1, further comprising a guide frame to guide the paper picked up by the pickup member, wherein the first link and the second link are pivotally rotatably installed to the guide frame.

8. The apparatus according to claim 7, wherein the separating unit includes a separating roller provided with a torque limiter to apply resistance force in an opposite direction of a paper delivery direction.

9. The apparatus according to claim 7, wherein the separating unit includes a pad member to apply resistance force in the opposite direction of a paper delivery direction.

10. An image forming apparatus comprising:

a main body containing a printing device;

a paper feeding cassette configured to accommodate paper therein and separably mounted to the main body;

a support frame arranged within the main body;

a pickup roller rotatably installed to the support frame and serving to pick up the paper from the paper feeding cassette;

a forward roller rotatably installed to the support frame and serving to deliver the paper picked up by the pickup roller; and a paper separating member to separate plural sheets of paper, picked up by the pickup roller, into individual sheets, wherein the paper separating member includes a guide frame;

a plurality of links pivotally rotatably installed to the guide frame, the plurality of links including a first link and a second link connected to each other via an elastic member, and one end of the elastic member being supported by the first link and the other end of the elastic member being supported by the second link; and a separating unit coupled to any one of the plurality of links, the separating unit coming into contact with the forward roller when the paper feeding cassette is mounted to the main body, wherein the first link and the second link are pivotally rotated in opposite directions when the paper feeding cassette is mounted to or separated from the main body.

11. The apparatus according to claim 10, wherein the paper feeding cassette applies pressure to the paper separating member when the paper feeding cassette is mounted to the main body and releases the pressure applied to the paper separating member when the paper feeding cassette is separated from the main body.

12. The apparatus according to claim 11, wherein the paper feeding cassette includes:

a cassette body in which the paper is accommodated;

a knock-up plate pivotally rotatably provided in the paper feeding cassette to support the paper accommodated in the paper feeding cassette; and a press member provided at a front surface of the paper feeding cassette to press the paper separating member when the paper feeding cassette is mounted to the main body.

13. The apparatus according to claim 12, wherein the press member protrudes forward from the front surface of the paper feeding cassette.

14. The apparatus according to claim 13, wherein one end of the first link includes a contact surface to come into contact with the press member and the other end of the first link includes a first support portion to support the end of the elastic member, and wherein one end of the second link includes a coupling portion coupled to the separating unit and the other end of the second link includes a second support portion to support the other end of the elastic member.

15. The apparatus according to claim 14, wherein the first link comes into contact with the press member and is pivotally rotated to press the elastic member when the paper feeding cassette is mounted to the main body, and wherein the elastic member pressed by the first link pivotally rotates the second link to press the forward roller.

16. The apparatus according to claim 10, wherein the guide frame includes a support rib to restrict pivotal rotation of the first link when the paper feeding cassette is separated from the main body.

17. The apparatus according to claim 10, wherein the separating unit includes a separating roller provided with a torque limiter to apply resistance force in an opposite direction of a paper delivery direction.

18. The apparatus according to claim 10, wherein the separating unit includes a pad member to apply resistance force in the opposite direction of a paper delivery direction.

* * * * *